United States Patent [19]

Hahn

[11] Patent Number: 4,867,339

[45] Date of Patent: Sep. 19, 1989

[54] TRASH CAN

[76] Inventor: William N. Hahn, 114 Virginia St., Apt. 208, Richmond, Va. 23219

[21] Appl. No.: 877,043

[22] Filed: Jun. 23, 1986

[51] Int. Cl.[4] ..... B65D 90/00

[52] U.S. Cl. ..... 220/404

[58] Field of Search ..... 220/404, 403, 1 T, 74, 220/94 A; 248/95, 100; 53/390

[56] References Cited

U.S. PATENT DOCUMENTS

| | | | |
|---|---|---|---|
| D. 187,161 | 2/1960 | Bliss | D34/1 |
| 1,455,536 | 5/1923 | Lebherz | 248/100 X |
| 2,634,020 | 4/1953 | Bartholomew | 220/74 X |
| 3,128,904 | 4/1964 | Reilly | 220/65 |
| 3,130,853 | 4/1964 | Colthurst et al. | 248/100 X |
| 3,784,049 | 1/1974 | Hawk | 220/63 |
| 4,027,774 | 6/1977 | Cote | 220/63 |
| 4,062,170 | 12/1977 | Orem | 53/390 |
| 4,332,361 | 6/1982 | McClellan | 248/95 |
| 4,418,835 | 12/1983 | Watts | 220/404 |
| 4,437,634 | 3/1984 | Hambleton | 248/97 |
| 4,558,800 | 12/1985 | Isgar et al. | 220/403 |
| 4,576,310 | 3/1986 | Isgar et al. | 220/403 X |
| 4,589,570 | 5/1986 | Auten | 220/404 |

*Primary Examiner*—Steven M. Pollard

*Attorney, Agent, or Firm*—Griffin, Branigan & Butler

[57] ABSTRACT

A rectangular cross-sectioned trash can (10) is disclosed which includes a downwardly directed lobe (26) extending from the upper end of each of end wall (12) and sidewall (14). Disposable flexible plastic bags are suspended in the trash can by placing handle hand openings (34) of the flexible plastic bags over opposite lobes so that weight in the plastic bags (38), acting in the trash can 10, tends to pull the bag handles up onto the lobes. In one embodiment the lobes are tapered. The tapered lobes tend to open the plastic bags for receiving trash. Because the trash can has lobes both on side-and end walls, it can be used with flexible plastic bags having handles at either sides or ends.

6 Claims, 1 Drawing Sheet

TRASH CAN

BACKGROUND OF THE INVENTION

This invention relates generally to the art of lined trash cans and more particularly to an improved trash can which can be easily used to suspend disposable flexible plastic bags having handles, of a type often given away by stores.

In recent years grocery and department stores have often packaged goods purchased therein in thin, flexible, plastic bags having integral plastic handles. Such bags, when opened, are approximately 14 to 15 inches high, 12 inches wide, and 6 inches in depth. Although many customers have long used paper bags obtained in this manner from stores as trash can liners, plastic bags with integral flexible handles have in many cases not been totally satisfactory as waste containers because the bags are so flexible they tend to fall into the trash cans and the handles have a tendency to get in the way of someone trying to put refuge into trash cans. When the bags have been sufficiently tall relative to the trash cans that the mouths thereof could be folded over the top rims of the trash cans to hang outside for holding the bags up, the top portions of the bags remained unused as receptacles. It is therefore an object of this invention to provide a trash can with which flexible plastic bags having integral flexible handles can be used as satisfactory liners in that they do not fall down into the can, the handles do not impede refuge from entering the trash can, and the entire bag is used as a receptacle.

Holders for trash can plastic bag liners have been suggested for engaging the mouths of plastic bags and holding them open near the rims of trash cans. However, such prior art suggestions have been generally unsatisfactory because they have torn the bags, used up otherwise useful space, tended to catch on articles other than plastic bags, and/or have been unsightly in appearance. It is an object of this invention to provide an arrangement for holding the handles of flexible plastic bags on the outside of rims of trash cans which does not have any of the above described disadvantages.

It is yet another object of this invention to provide a trash can having structure for suspending a flexible plastic bag with flexible handles from the rim thereof into the interior thereof which is pleasing in appearance, effective in operation, structurally strong, and streamline in form.

It is yet another object of this invention to provide such a trash can which is inexpensive to construct and uncomplicated to use.

SUMMARY

According to principles of this invention, a rectangular trash can has downwardly directed, thin, lobes attached to the top rim on the exterior thereof. In this regard, there is a lobe placed in the middle of each sidewall and a lobe placed in the middle of each end wall. Each of the lobes is attached by a wider upper end to the rim of its respective wall and each of the lobes extends approximately vertically downwardly therefrom. In one embodiment the lobes are tapered. In use, two opposite lobes are each inserted into opposite hand openings of flexible, plastic-bag handles and the flexible plastic bag is suspended into the trash can. The trash can can be used to suspend flexible plastic bags having handles either at the ends or at the sides.

BRIEF DESCRIPTION OF THE DRAWINGS

The foregoing and other objects features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner

DESCRIPTION OF THE PREFERRED EMBODIMENT

Figure 1:
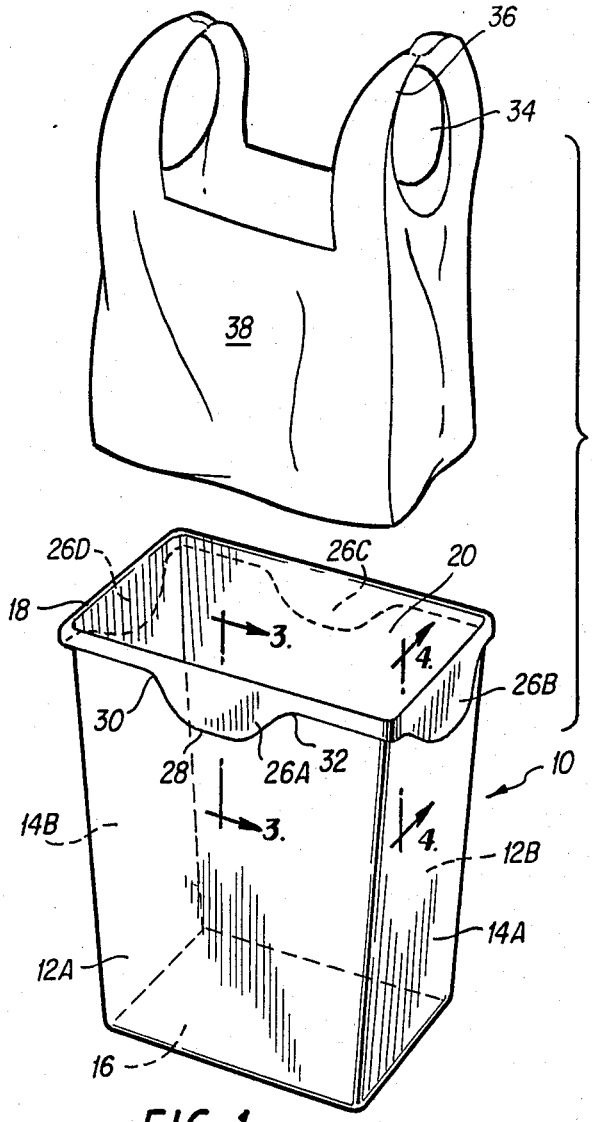
FIG. 1 is an exploded, isometric view of a trash can of this invention with a flexible plastic bag liner having flexible integral handles at the ends thereof.
Figure 2:
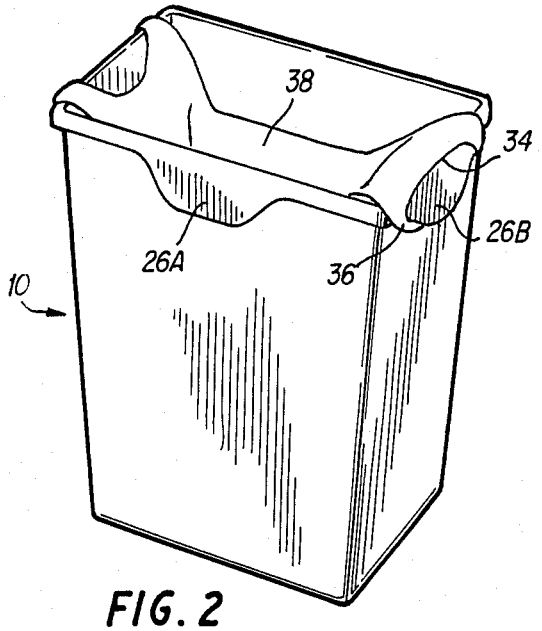
FIG. 2 is an isometric view of the trash can and flexible plastic bag of FIG. 1 with the plastic bag being suspended in the trash can from lobes of the trash can according to this invention.
Figure 3:
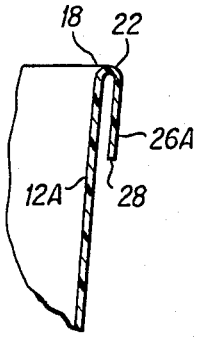
FIG. 3 is a side cross-sectional view taken on line 3—3 in FIG. 1.
Figure 4:
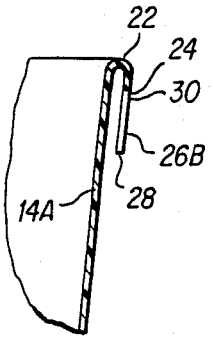
FIG. 4 is a cross-sectional view taken on line 4—4 in FIG. 1.
Figure 5:
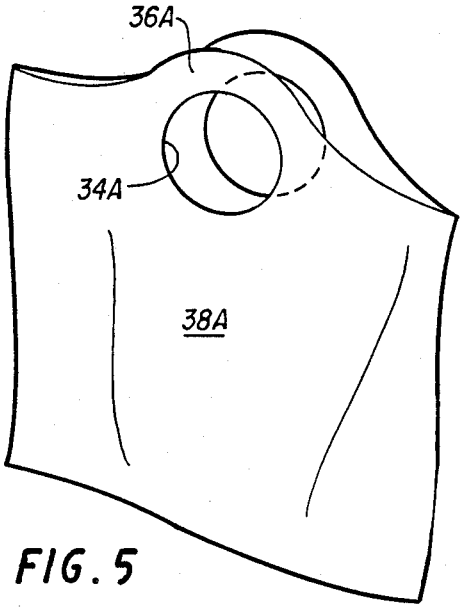
FIG. 5 is an isometric view of a flexible plastic bag liner having integral handles positioned at the sides of the trash can rather than at the ends thereof; and, FIG. 6 is an isometric view of a portion of another trash can embodiment of this invention.

Referring to FIG. 1, a rectangular hardplastic trash can has slightly-tapered sidewalls 12A and 12B, slightly-tapered end walls 14A and 14B and a bottom wall 16. Upper ends of the side-and end walls 12A and 12B and 14A and 14B form a rim 18 which defines a mouth opening 20 for receiving trash. At the rim 18, integral with the side-and end walls 12A and 12B and 14A and 14B is an outwardly directed ledge 22 (FIG. 3) which extends completely about the rim 18. As can be seen in FIG. 4, this ledge 22 extends outwardly and downwardly a short distance terminating at 24. However, integral with the ledge 22 are approximately-vertical, downwardly-directed thin lobes 26A, B, C, and D. It can be seen that each of these lobes is centered on its respective wall and that the lobes provide opposite side pairs 26A and 26C and opposite end pairs 26B and 26D. In the FIG. 1 embodiment the lobes 26A–B have narrowed bottom ends 28 and wider upper bases 30 where they are molded or attached to the ledge 22. The lobes 26A–D have side edges 32 which are sufficiently vertical that when a lobe 26A–D is respectively inserted into a hand opening 34 of a flexible integral handle 36 of a flexible plastic bag 38, with the flexible plastic bag 38 being suspended in the mouth opening 20 of the trash can 10, then the weight of the trash bag and items of trash therein cause the flexible handles 36 to ride up on the lobe. Thus, a bag having two of its handles so engaged is held suspended at the rim 18 by two lobes. This invention can be used with flexible plastic bags 38 of the type shown in FIG. 1 with handles at ends thereof, or of the type 38A shown in FIG. 5 with handles at the sides thereof because there are lobes at both the side-and end walls of the trash can 10. Like numbers are used to designate hand openings, handles, and bags in Figs. 1 and 5, however, the numerals of FIG. 5 have suffix "A" to indicate that these side-handle elements are somewhat different than the end-handles of bag of FIG. 1.

It should be appreciated that all elements of the trash can 10, including the side-and end walls 12A, B and 14A, B, the bottom wall 16, the ledge 22, and the lobes 26A–D are formed of one integral piece of plastic by molding. It should be noted that the lobes 26A–D depicted have rounded corners for pleasant appearance and for effective strength characteristics, however, they could be shaped more pointedly to make them more functionally effective, if required. The downwardly directed lobes would normally be in an approximate vertical position, although some deviation thereto is acceptable. The lobes have a vertical length and sideedge 32 configuration which prevents a bag handle from releasing from the lobe, and thereby causes the bag to be held in the can. In this regard, as the handle 36 or 36A rides up the tapered lobe the handle is caused to extend to follow the taper, thereby forcing the bag open.

Figure 6:
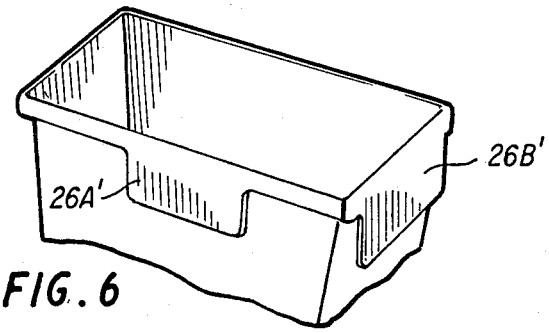

FIG. 6 depicts another embodiment wherein lobes 26A' and 26B' have rectangular shapes and are not substantially tapered. These lobes will work for particular size bags but do not have the advantage of fitting many different size bags as do the tapered lobes.

This invention can be used with plastic bags manufactured under the trademark "LIN PAC" which are approximately, when expanded, 14 inches high, 12 inches wide, and 6 inches deep. When used with such plastic bags, which are commonly given out at retail stores, the width of the trash can sidewalls 12A is approximately 16 inches and the width of the end walls 12B is approximately 8 inches. The height of the trash can 10 is greater than the height of the plastic bag 38 and in a preferred embodiment, it is around 17 inches. However, it should be understood that the principles of this invention are applicable plastic bags and trash cans of dimensions other than those given here.

It can be appreciated by those skilled in the art that the trash can disclosed herein is pleasing in appearance and quite sturdy. At the same time, this trash can allows effective use of a freely available plastic bag as a liner in such a manner that the liner is held securely to the rim of the trash can and is suspended tightly within the trash can. The liner's handles do not get in the way. At the same time, the lobes of the trash can open the mouth of the liner for receiving items of trash therein. Further, the trash can of this invention is relatively inexpensive to manufacture and quite uncomplicated in use. The lobes 26A–D do not not get in the way and do not use space which is otherwise available, since they are positioned along walls and are directed downwardly of the trash can.

It will be understood by those skilled in the art that various changes of form and detail may be made in this invention without departing from the spirit and scope thereof. For example, it would be possible to provide a flange kit having lobes designed to be fastened to an already available trash can.

The embodiments of the invention in which an exclusive property or privilege are claimed are defined as follows:

1. A trash can with which flexible plastic bags of various sizes having integral flexible plastic handles at either ends or sides thereof defining hand openings can be used as liners by suspending the bags within the trash can from the trash can's rim, the trash can having an approximate rectangular cross-sectional shape, the trash can comprising:

two sidewalls, two end walls, and a bottom wall said side and end walls defining an approximately rectangularly shaped mouth at the top of the trash can for receiving trash;

the trash can further including only one downwardly extending lobe on the outside thereof attached to the top edge of each of said two sidewalls and said two end walls, the lower end of each of said lobes being horizontally spaced from its respective wall, and each of said lobes being attached at its upper end to the upper edge of its respective wall at said mouth opening and each of said lobes extending approximately vertically downwardly therefrom to said lower end; said lower end being sufficiently narrow to allow said lower end to pass through said handle hand openings and having side edges sufficiently vertically oriented to retain said lobes in said handle openings as downward force is applied to the bottom of said bag on the interior of said trash can, but said upper end being sufficiently wide to laterally extend the handle toward its full width and thereby hold the bag open;

whereby bottom ends of said flexible plastic bags of various sizes can be placed in said trash can through said trash can mouth and said two integral flexible handles of the respective bags can be placed about two of the lobes on opposite walls of said trash can with said lobes extending into said hand openings in said handles, the weight of the bottoms of the bags pulling said handles up onto said lobes and the widths of said lobes laterally extending said handles toward their full widths to thereby hold said bags open.

2. A trash can as in claim in wherein each of said lobes is tapered with said lower end being relatively narrow for easily passing through said hand openings, and said upper end being much wider at its attachment to said top edge of its respective wall for extending said plastic handles laterally toward their full widths, whereby weight at the bottoms of said various size bags, tends to pull said handles up onto said tapered lobes, causing the handles to be laterally extended to force said various size bags open.

3. A trash can as in claim 2 wherein said lobes have rounded lower ends.

4. A trash can as in claim 2 wherein said sidewalls are relatively wide and said end walls are relatively narrow.

5. A trash can as in claim 1 wherein said lobes are formed as a single piece, of the same material, with said walls of said trash can in a single molding step.

6. A trash can as in claim 1 wherein said sidewalls are relatively wide and said end walls are relatively narrower.

* * * * *